US009850026B2

(12) United States Patent
Chiu

(10) Patent No.: US 9,850,026 B2
(45) Date of Patent: Dec. 26, 2017

(54) EASY-OPEN CAN END OPENED BY ROTATED BAR

(71) Applicant: Po-Hsien Chiu, Changhua County (TW)

(72) Inventor: Po-Hsien Chiu, Changhua County (TW)

( * ) Notice: Subject to any disclaimer, the term of this patent is extended or adjusted under 35 U.S.C. 154(b) by 76 days.

(21) Appl. No.: 15/098,310

(22) Filed: Apr. 13, 2016

(65) Prior Publication Data

US 2017/0297763 A1 Oct. 19, 2017

(51) Int. Cl.
*B65D 17/00* (2006.01)

(52) U.S. Cl.
CPC .... *B65D 17/165* (2013.01); *B65D 2517/0011* (2013.01); *B65D 2517/0074* (2013.01); *B65D 2517/0077* (2013.01)

(58) Field of Classification Search
CPC ..... B65D 17/165; B65D 51/222; B65D 2517/002; B65D 2517/0011; B65D 2517/007; B65D 2517/0074; B65D 17/166
See application file for complete search history.

(56) References Cited

U.S. PATENT DOCUMENTS 3,383,007 A * 5/1968 Salamone ..... B65D 17/18 220/277
3,726,432 A * 4/1973 Gentile ..... B65D 17/165 220/253
3,880,319 A * 4/1975 Wells ..... B65D 17/166 220/278
4,345,696 A * 8/1982 Guimarin ..... B65D 17/161 220/277
4,821,912 A * 4/1989 Wells ..... B65D 17/166 220/231
5,711,448 A 1/1998 Clarke, III
2010/0059516 A1* 3/2010 Parker ..... B65D 17/161 220/268
2012/0138621 A1* 6/2012 Bratsch ..... B65D 17/166 220/780
2014/0061150 A1* 3/2014 Park ..... B65D 21/0231 215/378

FOREIGN PATENT DOCUMENTS

| | | | |
|---|---|---|---|
| CN | 2075177 | U | 4/1991 |
| CN | 2098471 | U | 3/1992 |
| CN | 2117332 | U | 9/1992 |
| CN | 2230281 | Y | 7/1996 |
| CN | 204642568 | U | 9/2015 |
| JP | 2000255688 | A | 9/2000 |
| TW | 183426 | | 5/1992 |

* cited by examiner

*Primary Examiner* — Daniel J Colilla

(57) ABSTRACT

An easy-open can end for making an opening therethrough suitable for pouring comprises an end plate, a score line in the end plate defining most of the periphery of a tear panel while leaving a hinge, and a protrusion formed on the tear panel. To open the easy-open can end, the protrusion is pressed down by a rotating bar horizontally rotated over the protrusion or by a body vertically hitting the protrusion to cause relative vertical movement between the tear panel and the remainder of the end plate, rupture of the score line, and swinging of the tear panel down about the hinge to an open position.

13 Claims, 15 Drawing Sheets

EASY-OPEN CAN END OPENED BY ROTATED BAR

BACKGROUND

Technical Field

The subject matter described herein relates to an easy-open can end of a can and, and in certain embodiments to the opener to open the easy-open can end.

Description of the Related Art

The easy-open can ends are widely used in many containers, such as Aluminum or steel cans, typically filled with beer, soft drinks, tea, juice, water, concentrate, or the like. The traditional easy-open can is provided with an easy-open, stay-on-tab can end wherein a tab is secured to the end, such as the easy-open can end disclosed in U.S. Pat. No. 5,711,448.

However, the effort arm of the traditional easy-open can end is the tab, which is too short and can only contain one finger. Thus, a force that hurts a single finger may be required to open the tear panel in the easy-open can end while the tab fixed by the rivet could be broken by the required force. Further, the cost to assemble the tab and rivet on the easy-open can end cannot be saved.

Therefore, there is a requirement to address the above-mentioned issue.

BRIEF SUMMARY

To address the above-mentioned issues, an easy-open can end with a protrusion or impression formed on the tear panel is provided to be opened by a rotating bar horizontally rotated over the protrusion or impression.

The rotating bar may have a length equivalent to the diameter of the easy-open can, and the length is longer than a tab of the traditional easy-open can end. Thus, the rotating bar can provide a longer effort arm. And, the rotating bar can be rotated by two fingers, and thus can reduce the required force for each finger to open the easy-open can end. Moreover, a rotating bar is not required to be fixed in the easy-open can end, and thus the cost to assemble the tab and rivet on the easy-open can end is saved.

According to one embodiment of the present disclosure, an easy-open can end for making an opening therethrough suitable for pouring comprises: an end plate; a score line in the end plate defining most of the periphery of a tear panel, while leaving between the tear panel and the remainder of the end plate a hinge. The score line extends away from one end of the hinge, around a bight, and back to the other end of the hinge; and a protrusion formed on the tear panel wherein the protrusion is used for being pressed down by a rotating bar horizontally rotated over the protrusion or by a body vertically hitting the protrusion to cause relative vertical movement between the tear panel and the remainder of the end plate, rupture of the score line, and swinging of the tear panel down about the hinge to an open position.

According to another embodiment of the present disclosure, an easy-open can end for making an opening therethrough suitable for pouring comprises: an end plate; a score line in the end plate defining most of the periphery of a tear panel, while leaving between the tear panel and the remainder of the end plate a hinge. The score line extends away from one end of the hinge, around a bight, and back to the other end of the hinge; and an impression formed on the end plate with a slope on the tear panel and a main part on the remainder of the end plate wherein the impression is used for containing a downward protrusion of a rotating bar that is horizontally rotated over the tear panel from the slope to press down the tear panel to cause a relative vertical movement between the tear panel and the remainder of the end plate, rupture of the score line, and swinging of the tear panel down about the hinge to an open position.

According to another embodiment of the present disclosure, an opener for opening an easy-open can with a score line, a tear panel defined by the score line and a hinge, and a protrusion or an impression on an end plate, comprises: a rotating bar comprising two sections for being pushed close to each other or away from each other to adjust a horizontal length of the rotating bar, and a bottom used for being horizontally rotated over the tear panel to cause relative vertical movement between the tear panel and the remainder of the end plate, rupture of the score line, and swinging of the tear panel down about the hinge to an open position; and two fins connecting to the two sections and providing points pushed by fingers of a user to control the two sections.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn are not intended to convey any information regarding the actual shape of the particular elements, and they have been solely selected for ease of recognition in the drawings.

DETAILED DESCRIPTION

It will be appreciated that although specific embodiments of the subject matter of this application have been described herein for purposes of illustration, various modifications may be made without departing from the spirit and scope of the disclosed subject matter. Accordingly, the subject matter of this application is not limited except as by the appended claims.

In the following description, certain specific details are set forth in order to provide a thorough understanding of various aspects of the disclosed subject matter. However, the disclosed subject matter may be practiced without these specific details. In some instances, well-known structures and methods of attaching structures to each other comprising embodiments of the subject matter disclosed herein have not been described in detail to avoid obscuring the descriptions of other aspects of the present disclosure.

Reference throughout the specification to "one embodiment" or "an embodiment" means that a particular feature, structure, or characteristic described in connection with the embodiment is included in at least one embodiment. Thus, the appearance of the phrases "in one embodiment" or "in an embodiment" in various places throughout the specification are not necessarily all referring to the same aspect. Furthermore, the particular features, structures, or characteristics may be combined in any suitable manner in one or more aspects of the present disclosure.

Figure 1A:
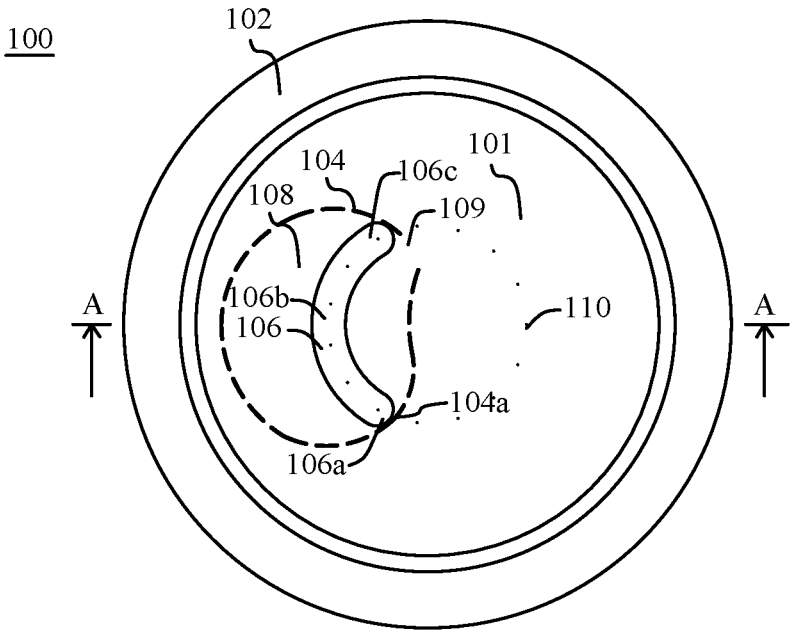
FIG. 1A is a top view of an easy-open can end of a can with a protrusion according to one embodiment of the present disclosure.

FIG. 1A is a top view of an easy-open can end of a can with a protrusion according to one embodiment of the present disclosure. An easy-open can end 100 for making an opening therethrough suitable for pouring comprises: an end plate 101; a score line 104 in the end plate 101 defining most of the periphery of a tear panel 108, while leaving between the tear panel 108 and the remainder of the end plate 101 a hinge 109. The score line 104 extends away from one end of the hinge 109, around a bight, and back to the other end of the hinge 109, and a protrusion 106 is formed on the tear panel 108.

Figure 1B:
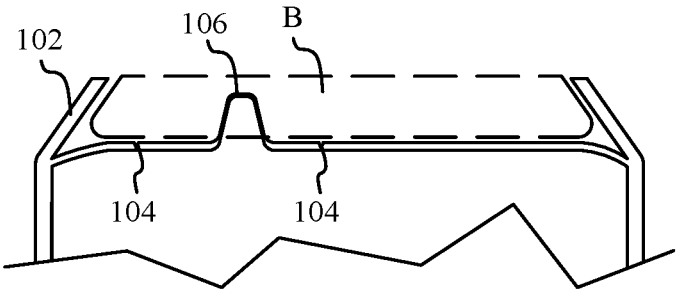
FIG. 1B is a cross-sectional view of the easy-open can end taken along a line A-A of FIG. 1A.
Figure 1C:
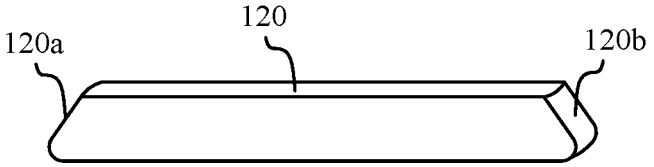
FIG. 1C is a perspective view of the rotating bar comprising two inclined ends.
Figure 1D:
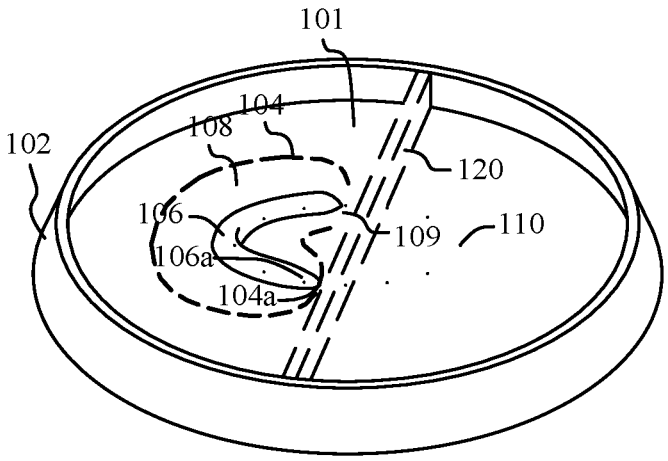
FIG. 1D is a perspective view of the easy-open can end with hidden lines showing that a rotating bar may be set inside the extended wall.

The protrusion 106 is used for being pressed down by a rotating bar 120 shown in FIG. 1D horizontally rotated over the protrusion 106 or by a body vertically hitting the protrusion 106 to cause relative vertical movement between the tear panel 108 and the remainder of the end plate 101, rupture of the score line 104, and swinging of the tear panel 108 down about the hinge 109 to an open position.

FIG. 1B is a cross-sectional view of the easy-open can end taken along a line A-A of FIG. 1A. The line A-A is a center line of the tear panel that passes through the center of the end plate and the center of the tear panel. FIG. 1B shows the protrusion 106, the score line 104, an extended wall 102, and a rotating space B defined by the extended wall 102. By referring to FIGS. 1A, 1B and 1D, the extended wall 102 encircles the end plate 101 and thus defines a rotating space B, wherein a circular opening of the extended wall 102 is narrower than a circular bottom of the extended wall 102. The rotating space B is used for containing the rotating bar 120 shown in FIG. 1C; and the extended wall 102 confines movement of the rotating bar 120.

FIG. 1C is a perspective view of the rotating bar 120 comprising two inclined ends 120*a*, 120*b*. The rotating bar 120 is flexible or has two rounded corners on bottom of the two inclined ends 120*a*, 120*b*, and thus the rotating bar 120 can be bent and set into the rotating space B through the narrower circular opening of the extended wall 102.

FIG. 1D is a perspective view of the easy-open can end with hidden lines showing that a rotating bar 120 may be set inside the extended wall 102. FIG. 1D shows a condition that the rotating bar 120 is set in a position without the protrusion 106 before the tear panel 108 is swung down about the hinge 109 to an open position.

Figure 2A:
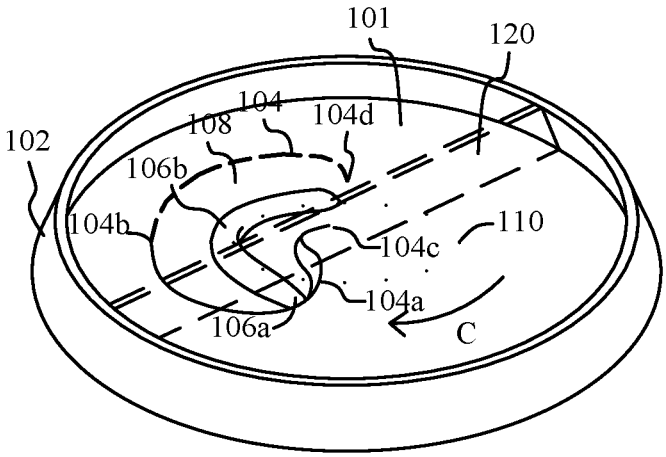
FIGS. 2A and 2B are perspective views illustrating steps for opening the easy-open can end of the embodiment shown in FIG. 1A.
Figure 2B:
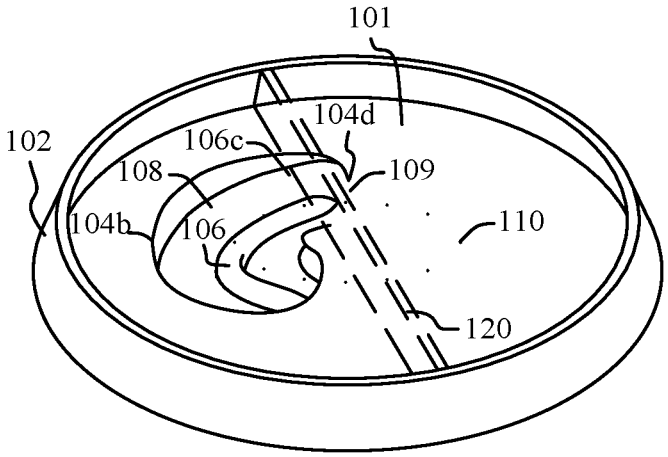

FIGS. 2A and 2B are perspective views illustrating steps for opening the easy-open can end of the embodiment shown in FIG. 1A. FIG. 2A shows that the rotating bar 120 is horizontally rotated over the protrusion 106 clockwisely in the direction of arrow C from the ramp 106*a* to press down the protrusion 106, and thus the relative vertical movement between the tear panel 108 and the remainder of the end plate 101 causes initial rupture of the score line 104 in point 104*a* close to ramp 106*a* while the rupture of the score line 104 reaches points 104*b* and 104*c* in two directions. In other words, while the rotating bar 120 climbs over the protrusion 106 through the ramp 106*a*, the rotating bar 120 keeps in the same level by pressing the protrusion 106 and the tear panel 108 down. After the rotating bar 120 passes the ramp 106*a*, the tear panel 108 can be further pressed down because the rotating bar 120 continues pressing the protrusion 106 down. FIG. 2B shows that the rotating bar 120 is horizontally rotated to the end 106*c* of the protrusion 106 to further press down the protrusion 106 and the tear panel 108 while propagation of the rupture continues to the hinge 109 at point 104*d*, the tear panel 108 is swung down about the hinge 109 to an open position.

To reduce the waste of resource, the rotating bar of the present invention can be a separable opener and the easy-open can may be produced without a rotating bar on its can end. Thus, the easy-open can end of the present invention can save a fixed opener, such as the stay-on-tab of the traditional easy-open can end disclosed in U.S. Pat. No. 5,711,448. In other words, a buyer may use his or her own opener with the same mechanism as the rotating bar to open the easy-open can end of the present invention, and thus the producer of the easy-open can saves the cost to manufacture and assemble the rotating bar.

Alternatively, an easy-open can may be manufactured with a rotating bar attached on its can end, and the rotating bar 120 of FIG. 1C may be included in the easy-open can end.

Figure 3A:
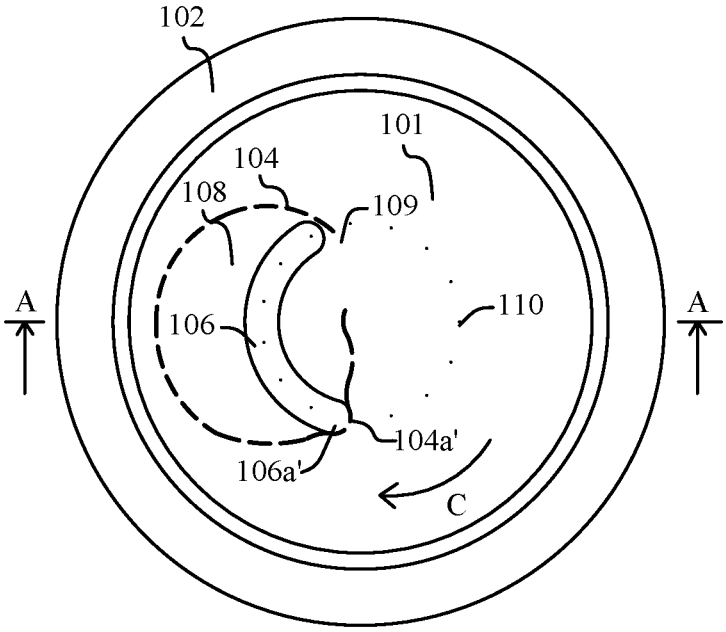
FIG. 3A is a top view of an easy-open can end with the tear panel having an extended part.

FIG. 3A is a top view of an easy-open can end of a can with the tear panel having an extended part according to another embodiment of the present disclosure. The tear panel 108 further comprises an extended part defined by the score line 104 that further extends around another bight in point 104*a*'. And, a ramp 106*a*' of the protrusion 106 is formed on the extended part of the tear panel. While the rotating bar reaches and press down the ramp 106*a*', the stress will be concentrated on the tip of the extended part, i.e., the point 104*a*', and thus the required force to initialize the rupture of the score line 104 in the point 104*a*' can be reduced.

Figure 3B:
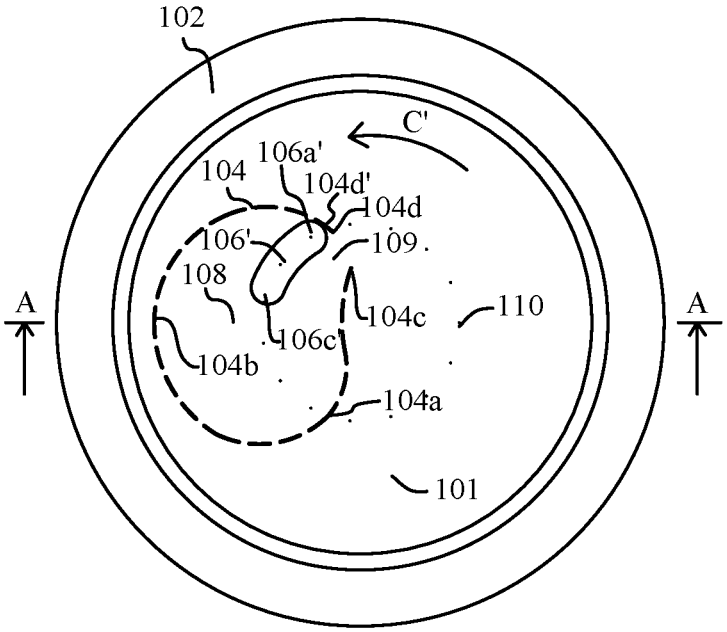
FIG. 3B is a top view of an easy-open can end produced for rotating the rotating bar in the counterclockwise direction.

While the hinge 109 is formed in one side of the tear panel 108 relative to the center line of the tear panel 108, i.e., the line A-A, the rotation of the rotating bar 120 can be started not only from the side distant from the hinge 109, for example, in the clockwise direction C shown in FIGS. 2A and 3A, but also from the side near the hinge 109. FIG. 3B is a top view of an easy-open can end produced for starting the rotation of the rotating bar 120 from the side near the hinge 109, for example, in the counterclockwise direction C'. In the example of FIG. 3B, while the rotating bar 120 is rotated in the direction C', the rupture of score line 104 may start from point 104*d*' and progress to point 104*d* and point 104*c* in two directions. The protrusion 106' may be shorter but higher than the protrusion 106 in FIG. 1A. Similarly, the protrusion 106' may also have a ramp 106*a*' in the start point of the rotation of the rotating bar 120 to allow the rotating bar 120 climbing over the protrusion 106'.

Figure 3C:
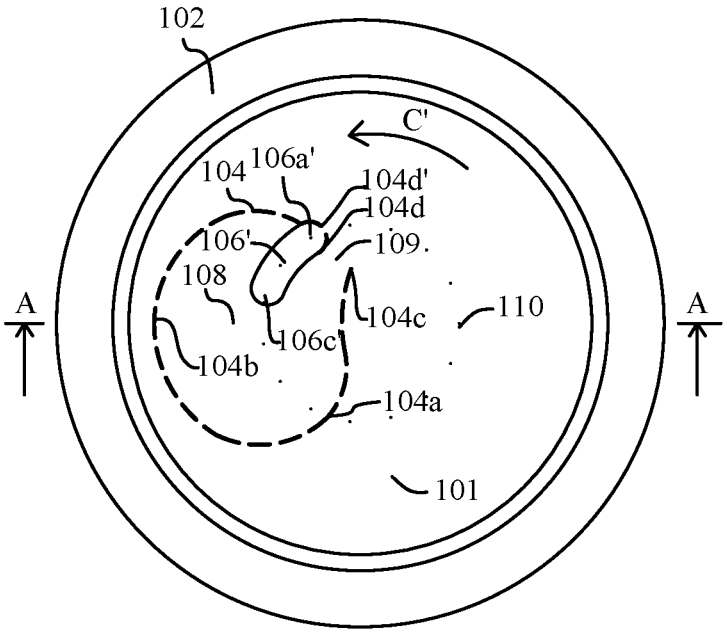
FIG. 3C is a top view of an easy-open can end produced for rotating the rotating bar in the counterclockwise direction with the tear panel having an extended part.

FIG. 3C is a top view of an easy-open can end with the tear panel 108 further comprising an extended part defined by the score line 104 that further extends around another bight in point 104*d*' for starting the rotation of the rotating bar 120 from the side near the hinge 109. And, a ramp 106*a*' of the protrusion 106 is formed on the extended part of the tear panel 108. While the rotating bar 120 reaches and press down the ramp 106*a*', the stress will be concentrated on the tip of the extended part, i.e., the point 104*d*', and thus the required force to initialize the rupture of the score line 104 in the point 104*d*' can be reduced.

Figure 3D:
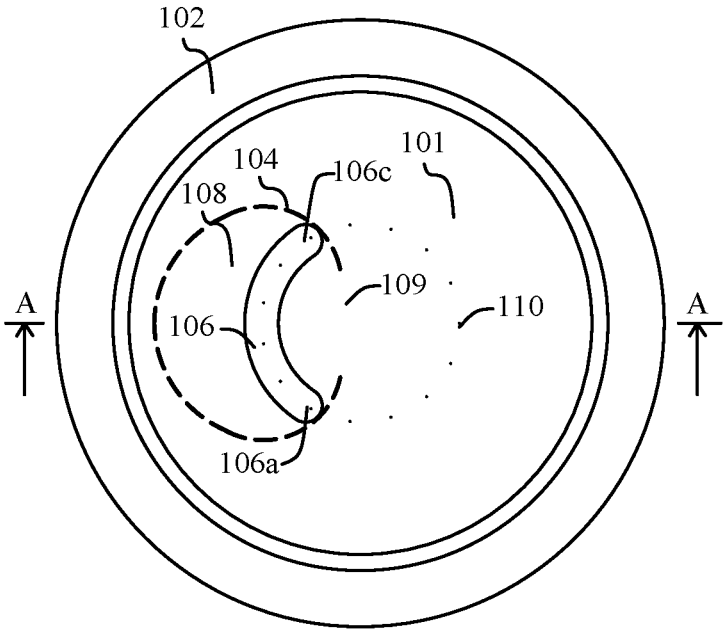
FIGS. 3D and 3E illustrate two further embodiments that the hinge is formed in a center line of the tear panel that passes through the center of the end plate and the center of the tear panel.
Figure 3E:
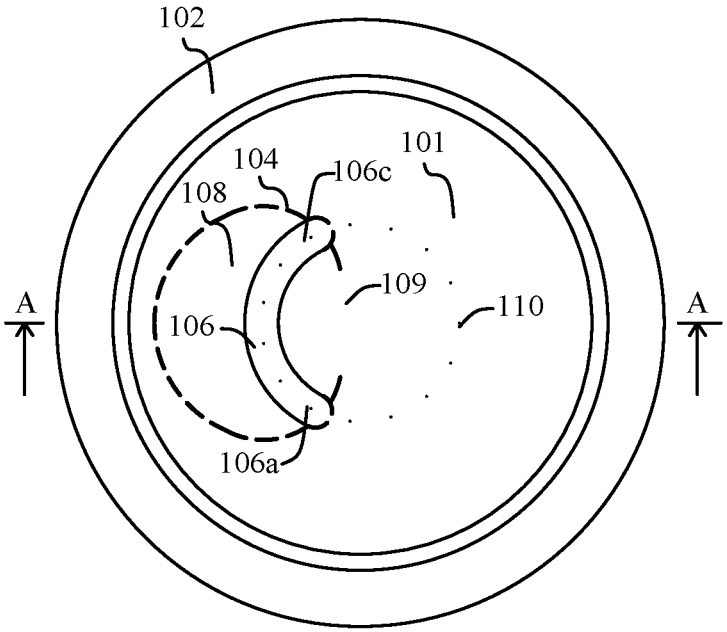

FIGS. 3D and 3E illustrate two embodiments that the hinge 109 is formed in the center line of the tear panel 108, i.e., the line A-A. Among them, the embodiment shown in FIG. 3E further comprises two extended parts of the tear panel 108 with two ramps 106*a*, 106*c* on the two extended parts of the tear panel 108. The clockwise and counterclockwise rotation will cause the same ruptures with different starting and ending points in the tear panel 108 if the shape of the tear panel 108 is symmetry.

Figure 7A:
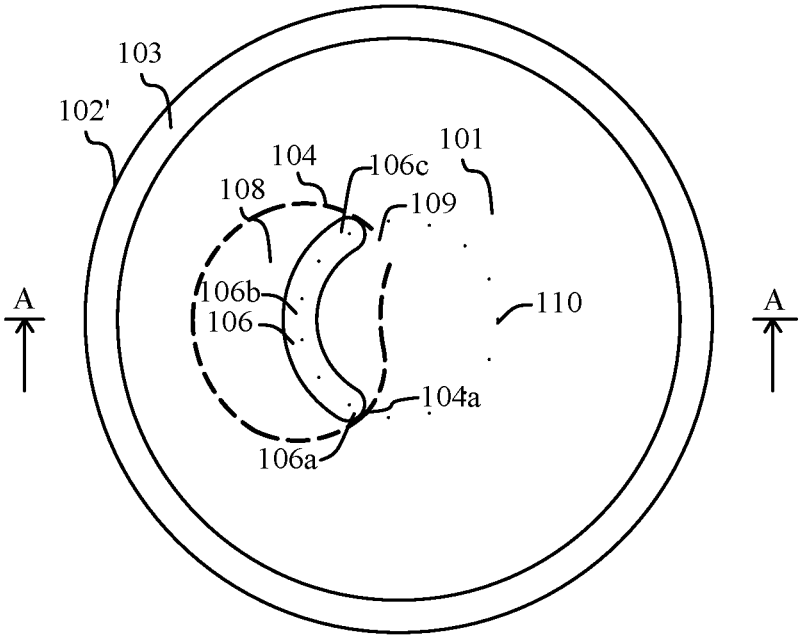
FIG. 7A shows another easy-open can end with a protrusion and a flared extended wall.
Figure 9A:
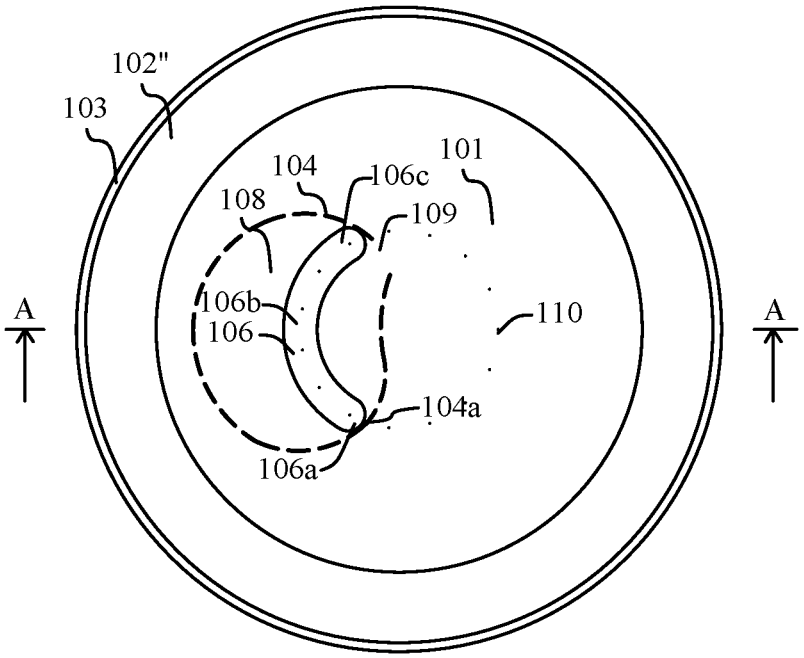
FIG. 9A shows another easy-open can end with a protrusion and another flared extended wall.

While FIGS. 1A and 1B illustrate that the extended wall 102 of the easy-open can end has a circular opening narrower than its circular bottom, FIGS. 7A and 9A illustrate another easy-open can ends with flared opens 103 on the extended walls 102', 102".

Figure 7B:
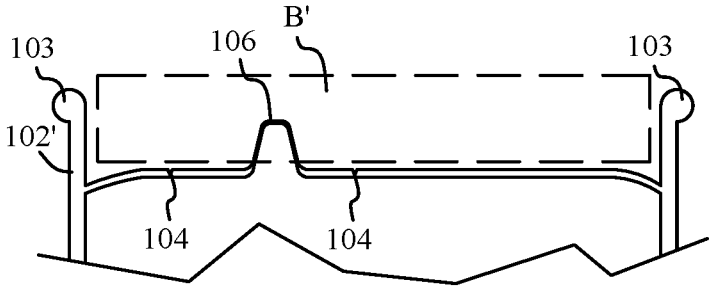
FIG. 7B is a cross-sectional view of the easy-open can end taken along the line A-A of FIG. 7A.
Figure 7C:
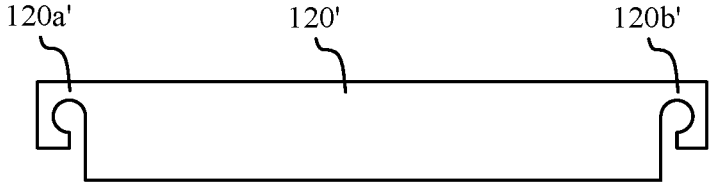
FIG. 7C is a cross-sectional view of a rotating bar with two flexible hooks on two ends.
Figure 9B:
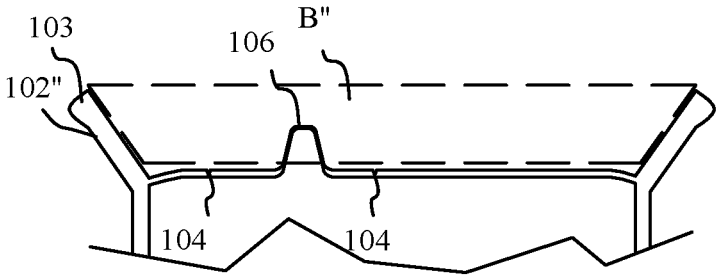
FIG. 9B is a cross-sectional view of the easy-open can end taken along the line A-A of FIG. 9A.

FIG. 7B is a cross-sectional view of the easy-open can end taken along the line A-A of FIG. 7A. The easy-open can end comprises the protrusion 106, the score line 104, and an extended wall 102' with a flared opening 103 encircling the end plate 101 and defining a rotating space B'. FIG. 7C is a cross-sectional view of rotating bar 120', which has two flexible hooks on two ends 120*a*', 120*b*'. The rotating bar 120' of FIG. 7C can be set into the rotating spaces B' shown in FIG. 7B by hooking the flared opening 103. Therefore, the rotating space B' is used for containing the rotating bar 120', and the extended wall 102' confines movement of the rotating bar 120'. The easy-open can end and the rotating bar of FIGS. 9A-C have different shapes from those of FIGS. 7A-C while having the same mechanism.

Figure 9C:
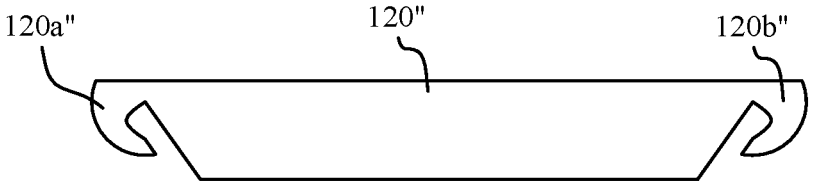
FIG. 9C is a cross-sectional view of a rotating bar with two flexible hooks on two ends.

Although the rotating bar of the present invention can be a separable opener, an easy-open can may be manufactured with a rotating bar attached on its can end, and the rotating bars 120', 120" of FIGS. 7C and 9C may be included in the easy-open can ends.

Figure 4A:
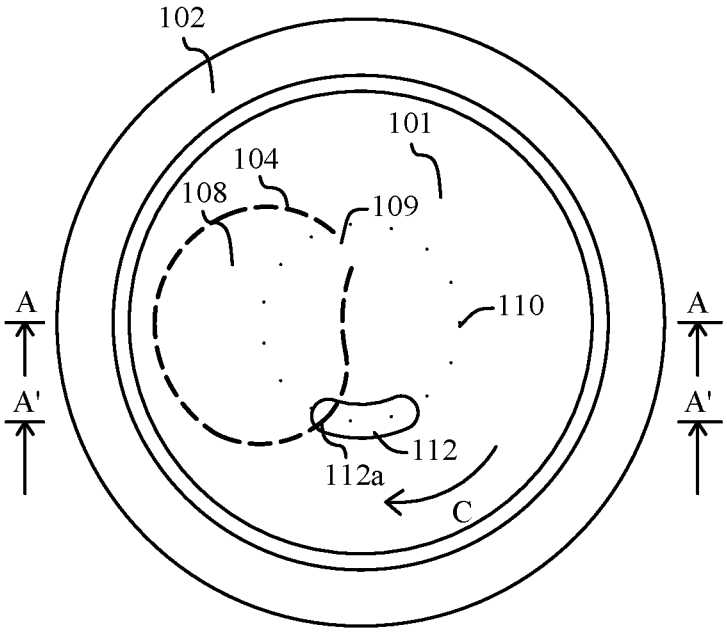
FIG. 4A is a top view of an easy-open can end of a can with an impression having a slope on a tear panel according to one embodiment of the present disclosure.

While a protrusion can be utilized to open an easy-open can, an impression can be also utilized to do the same. FIG. 4A is a top view of an easy-open can end of a can with an impression according to one embodiment of the present disclosure. An easy-open can end 100 for making an opening therethrough suitable for pouring comprises an end plate 101 and a score line 104 in the end plate 101 defining most of the periphery of a tear panel 108 while leaving between the tear panel 108 and the remainder of the end plate 101 a hinge 109. The score line 104 extends away from one end of the hinge 109, around a bight, and back to the other end of the hinge 109; and an impression 112 is formed on the end plate 101 with a slope 112*a* on the tear panel 108 and a main part on the remainder of the end plate 101.

The impression 112 is used for containing a downward protrusion 122 of a rotating bar 120 that is horizontally rotated over the tear panel 108 from the slope 112*a* to press down the tear panel 108 to cause a relative vertical movement between the tear panel 108 and the remainder of the end plate 101, rupture of the score line 104, and swinging of the tear panel 108 down about the hinge 109 to an open position.

Figure 4B:
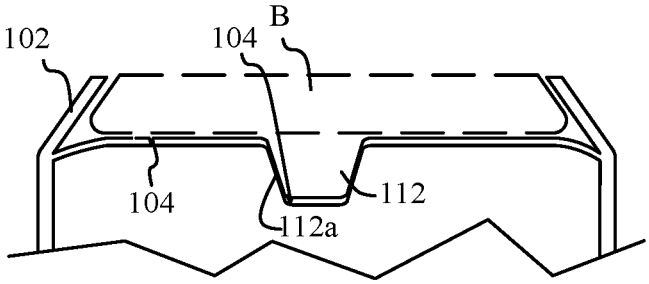
FIG. 4B is a cross-sectional view of the easy-open can end taken along a line A'-A' of FIG. 4A.

FIG. 4B is a cross-sectional view of the easy-open can end taken along a line A'-A' of FIG. 4A. The line A'-A' is a tangent line of circle 110 that passes through the impression 112. FIG. 4B shows the impression 112, the score line 104, an extended wall 102, and a rotating space B defined by the extended wall 102. By referring to FIGS. 4A, 4B and 4D, the extended wall 102 encircles the end plate 101 and thus defines a rotating space B, wherein a circular opening of the extended wall 102 is narrower than a circular bottom of the extended wall 102.

Figure 4C:
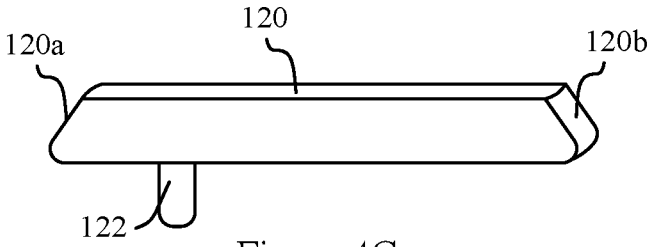
FIG. 4C is a perspective view of the rotating bar comprising two inclined ends and a downward protrusion.

Returning to FIG. 4B, the rotating space B is used for containing the rotating bar 120 shown in FIG. 4C, and the extended wall 102 confines movement of the rotating bar 120. FIGS. 4A and 4B illustrate the score line 104 extends through the bottom of the slope 112*a* and defines the slope 112*a* as part of the tear panel 108. The impression 112 is used for containing the downward protrusion 122 of the rotating bar 120 shown in FIG. 4C. The downward protrusion 122 in the impression 112 will apply a horizontal force on the slope 112*a* and initializes the rupture of the score line 104 while the rotating bar 120 is horizontally rotated to the tear panel 108 from the slope 112*a*.

FIG. 4C is a perspective view of the rotating bar 120 comprising two inclined ends 120*a*, 120*b*. The rotating bar 120 is flexible or has two rounded corners on bottom of the two inclined ends 120*a*, 120*b*, and thus the rotating bar 120 can be bent and set into the rotating space B through the narrower circular opening of the extended wall 102.

Figure 4D:
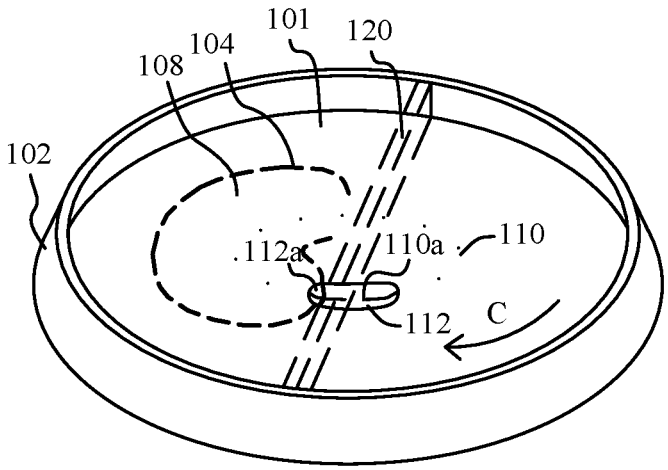
FIG. 4D is a perspective view of the easy-open can end with hidden lines showing that a rotating bar may be set inside the extended wall.

FIG. 4D is a perspective view of the easy-open can end with hidden lines showing that a rotating bar 120 may be set inside the extended wall 102. FIG. 4D shows a condition that the rotating bar 120 is set in a position over the impression 112 with the downward protrusion 122 inside the impression 112 before the rotating bar 120 is rotated clockwise and the tear panel 108 is swung down about the hinge 109 to an open position. The center line 110*a* of the impression 112 extends along the circle 110 to allow the movement of the downward protrusion 122 while the rotating bar 120 is rotated.

Although the rotating bar of the present invention can be a separable opener, an easy-open can may be manufactured with a rotating bar attached on its can end, and the rotating bar 120 of FIG. 4C may be included in the easy-open can end.

Figure 5A:
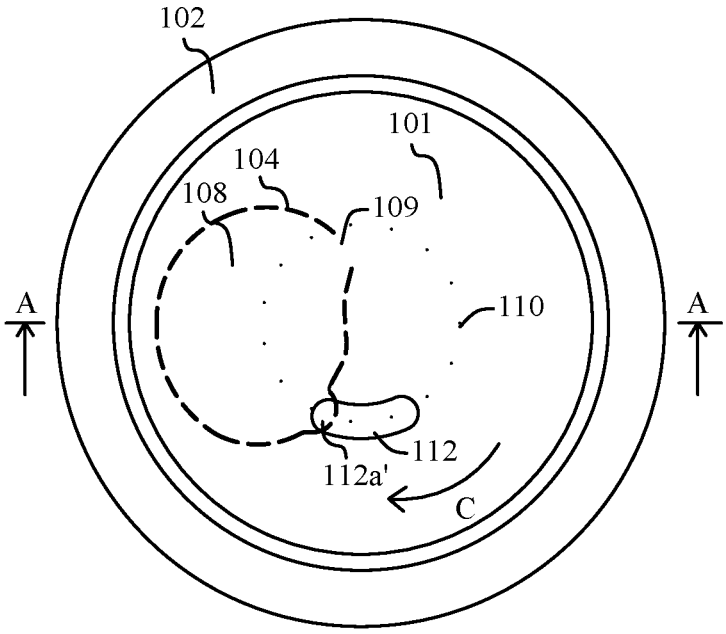
FIG. 5A is a top view of an easy-open can end of a can with an impression having a slope on an extended part of the tear panel.

FIG. 5A is a top view of an easy-open can end of a can according to another embodiment of the present disclosure. The tear panel 108 further comprises an extended part defined by the score line 104 that further extends around another bight in the impression 112. And, the slope 112*a*' of the impression 112 is on the extended part of the tear panel 108. While the rotating bar 120 reaches and press down the slope 112*a*', the stress will be concentrated on the tip of the extended part, and thus the required force to initialize the rupture of the score line 104 can be reduced.

While the hinge 109 is formed near one side of the tear panel 108 relative to a center line of the tear panel 108 that passes through the center of the end plate 101 and the center of the tear panel 108, i.e., the line A-A shown in FIG. 4A, the rotation of the rotating bar 120' can be started not only from a side of the tear panel 108 distant from the hinge 109, for example, in the clockwise direction C shown in FIG. 4A, but also from another side of the tear panel 108 near the hinge 109.

Figure 5B:
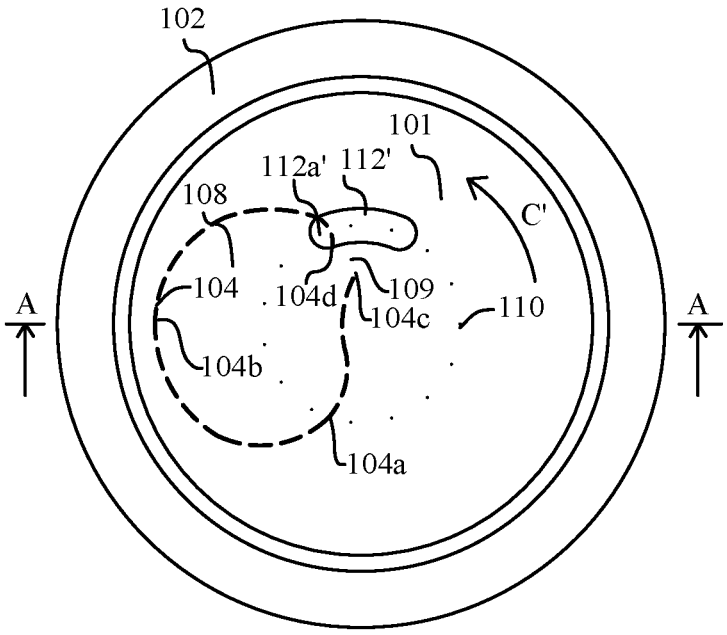
FIG. 5B is a top view of an easy-open can end produced with an impression for rotating the rotating bar in the counterclockwise direction.

FIG. 5B shows an embodiment that the rotation of the rotating bar 120' is started from another side of the tear panel 108 near the hinge 109, for example, in the counterclockwise direction C'. While the rotating bar 120 is rotated in the direction C', the rupture of score line 104 may progress from point 104*d* to point 104*c*. Similarly, the impression 112' may also have a slope 112*a*' in the tear panel 108.

Figure 5C:
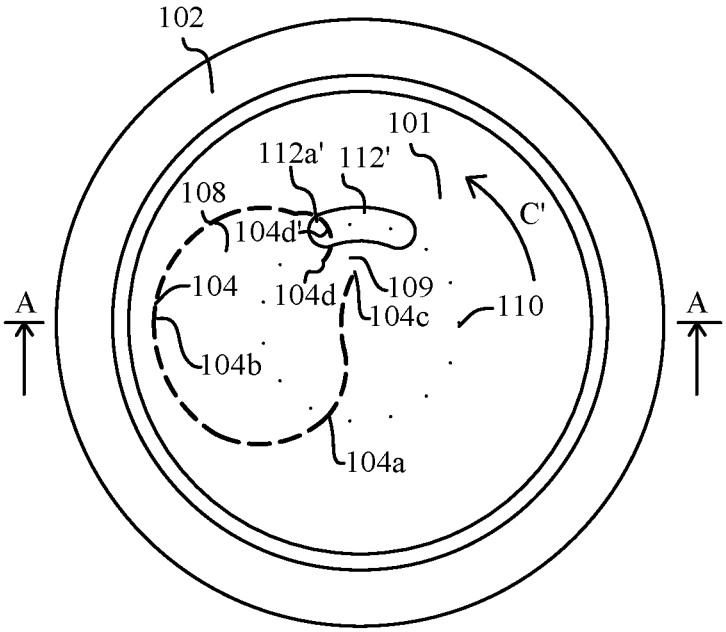
FIG. 5C is a top view of an easy-open can end produced with an impression for rotating the rotating bar in the counterclockwise direction with the tear panel having an extended part.

FIG. 5C shows another embodiment that the rotation of the rotating bar 120' is started from another side of the tear panel 108 near the hinge 109. The tear panel 108 further comprises an extended part defined by the score line 104 that further extends around another bight in point 104*d*'. And, a slope 112*a*' of the impression 112' is formed on the extended part of the tear panel 108. While the rotating bar 120' reaches and press down the slope 112*a*', the stress will be concentrated on the tip of the extended part, i.e., the point 104*d*', and thus the required force to initialize the rupture of the score line 104 in the point 104*d*' can be reduced.

Figure 5D:
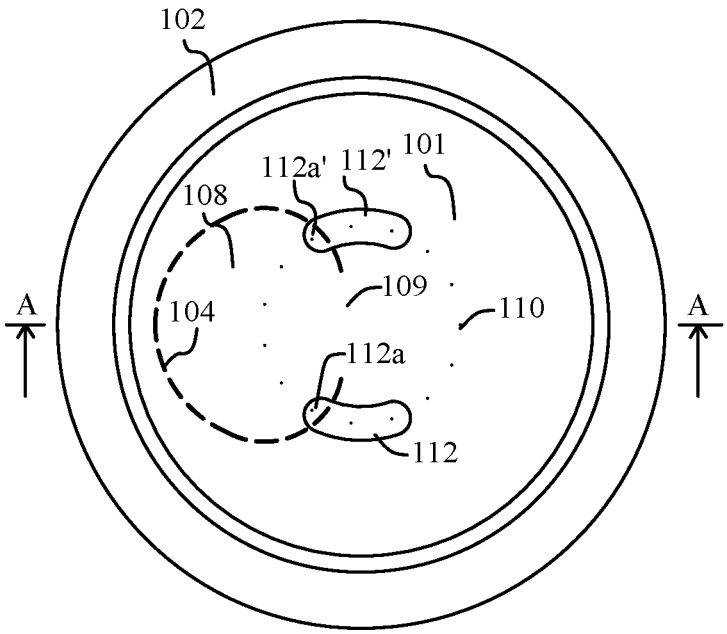
FIGS. 5D and 5E illustrate two further embodiments that the hinge is formed in a center line of the tear panel that passes through the center of the end plate and the center of the tear panel.
Figure 5E:
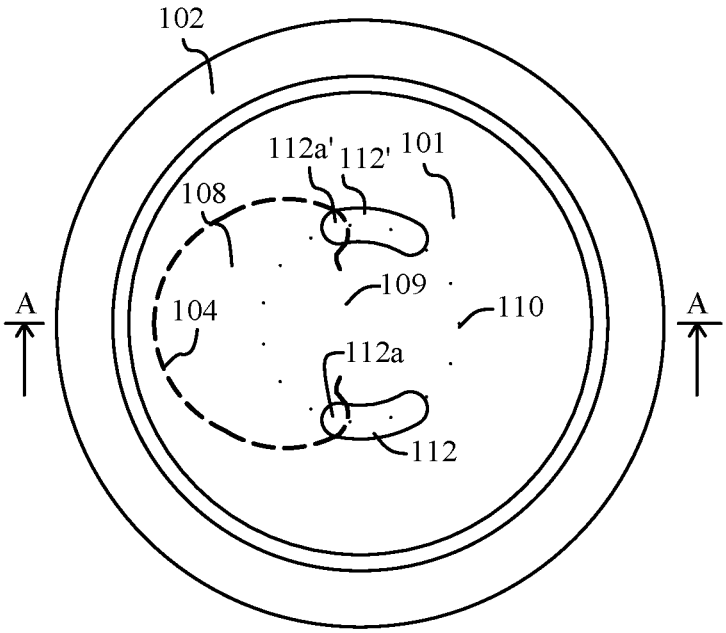

FIGS. 5D and 5E illustrate two further embodiments, each of which has a hinge 109 formed in a center line of the tear panel 108 that passes through the center of the end plate 101 and the center of the tear panel 108. Among them, the embodiment shown in FIG. 5E further comprises two extended parts of the tear panel 108 with two slopes 112*a* on the two extended parts of the tear panel 108. The clockwise and counterclockwise rotation will cause the same ruptures with different starting points and ending points in the tear panel 108 if the shape of the tear panel 108 is symmetry.

Figure 5F:
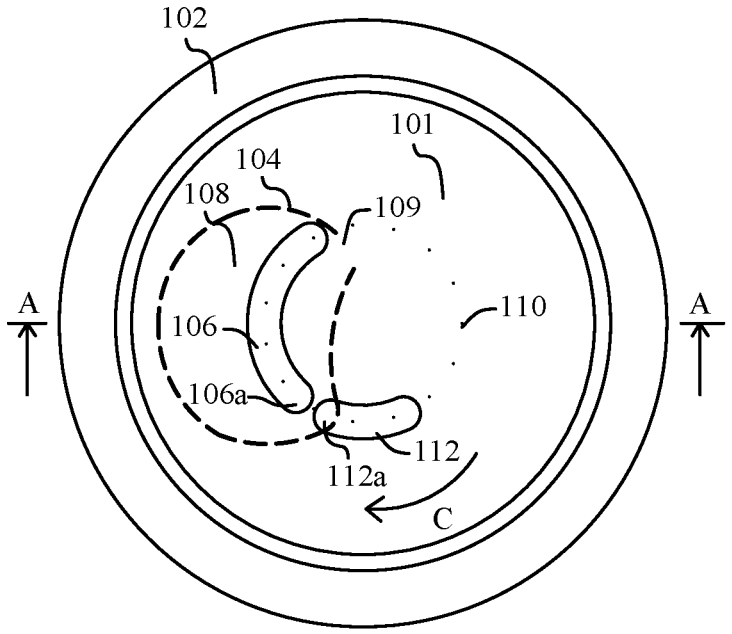
FIG. 5F is a top view of an easy-open can end produced with both protrusion and impression for rotating the rotating bar in the clockwise direction.
Figure 5G:
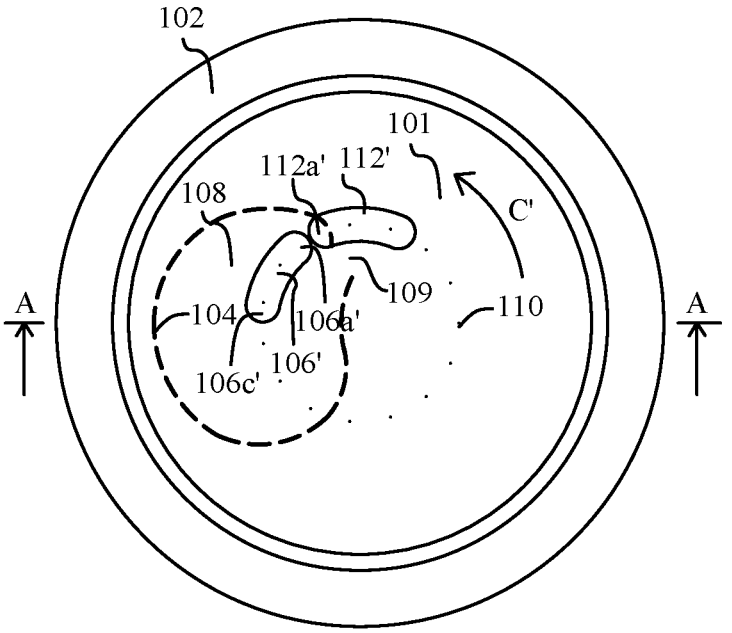
FIG. 5G is a top view of an easy-open can end produced with both protrusion and impression for rotating the rotating bar in the counterclockwise direction.

FIGS. 5F and 5G illustrate embodiments, each of which has both protrusion and impression. The rotation of the rotating bar 120' in FIG. 5F is started from a side of the tear panel 108 distant from the hinge 109 while the rotation of the rotating bar 120' in FIG. 5G is started from another side of the tear panel 108 near the hinge 109. To make the downward protrusion 122 go through both of impression 112, 112' and protrusion 106, 106', the protrusion 106, 106' and the impression 112, 112' are formed on the same circle 110 having the same center as the end plate 101. And, the protrusion 106, 106' has a ramp 106*a*, 106*a*' close to the slope 112*a*, 112*a*' of the impression 112, 112'.

Figure 8A:
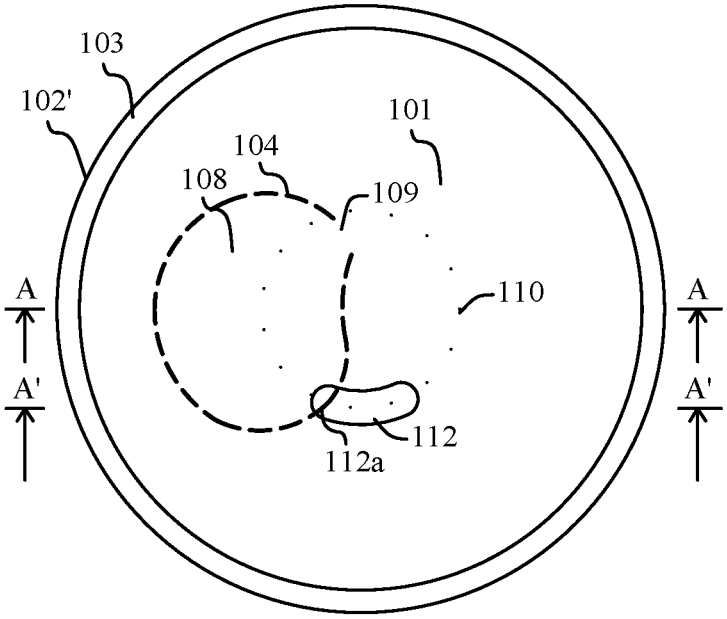
FIG. 8A shows another easy-open can end with an impression and a flared extended wall.
Figure 8B:
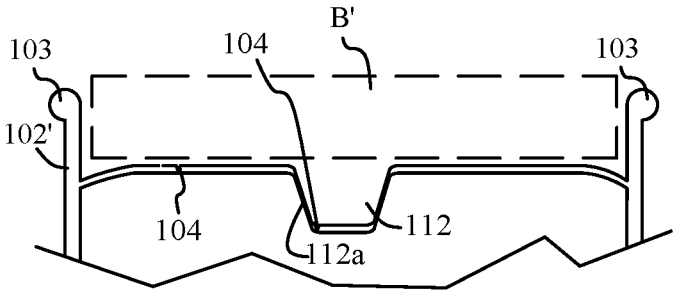
FIG. 8B is a cross-sectional view of the easy-open can end taken along the line A'-A' of FIG. 8A.
Figure 8C:
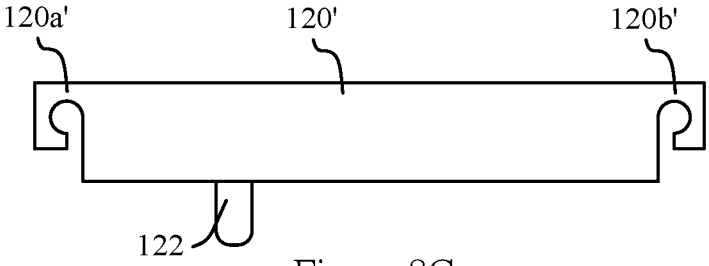
FIG. 8C is a cross-sectional view of a rotating bar comprising two flexible hooks on two ends and one downward protrusion in the bottom.

FIG. 8A shows another easy-open can end with flared extended wall 102'. FIG. 8B is a cross-sectional view of the easy-open can end taken along the line A'-A' of FIG. 8A. The easy-open can end comprises the impression 112, the score line 104, and an extended wall 102' with a flared opening 103 on its top encircling the end plate 101 and defining a rotating space B'. FIG. 8C is a cross-sectional views of rotating bar 120'. The rotating bar 120' has two flexible hooks on two ends 120*a*', 120*b*' and a downward protrusion 122 in the bottom, and the rotating bar 120' can be set into the rotating spaces B' shown in FIG. 8B by hooking the flared opens 103. Therefore, the rotating space B' is used for containing the rotating bar 120', and the extended wall 102' confines movement of the rotating bar 120'.

Figure 10A:
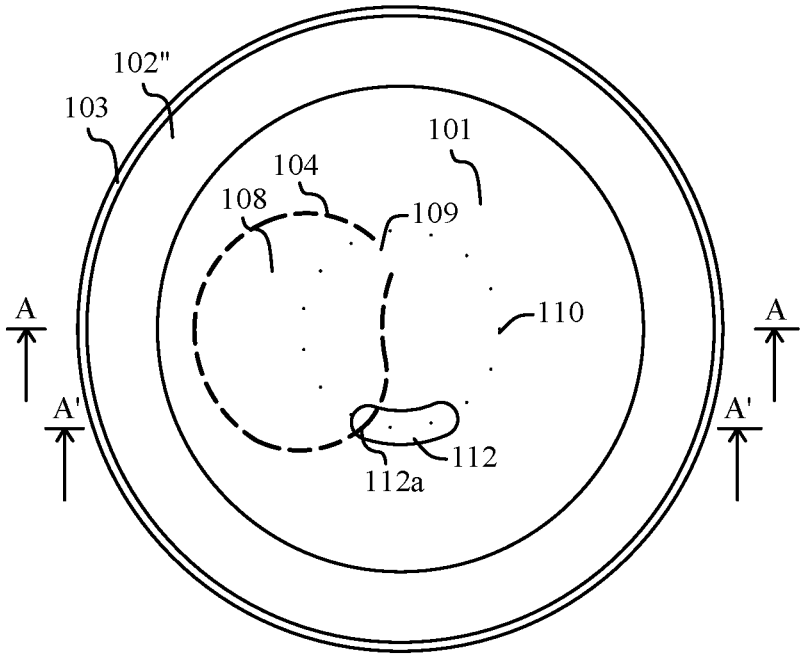
FIG. 10A shows another easy-open can end with a protrusion and another flared extended wall.
Figure 10B:
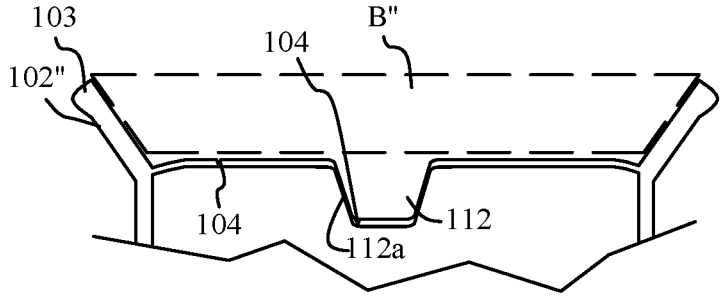
FIG. 10B is a cross-sectional view of the easy-open can end taken along the line A'-A' of FIG. 10A.
Figure 10C:
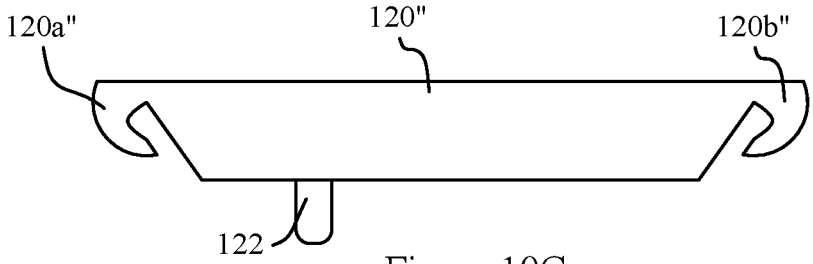
FIG. 10C is a cross-sectional view of a rotating bar comprising two flexible hooks on two ends and one downward protrusion in the bottom.

The easy-open can end and the rotating bar of FIGS. 10A-C have different shapes from those of FIGS. 8A-C while having the same mechanism.

Although the rotating bar of the present invention can be a separable opener, an easy-open can may be manufactured with a rotating bar attached on its can end, and the rotating bars 120', 120" of FIGS. 8C and 10C may be included in the easy-open can ends.

Figure 6A:
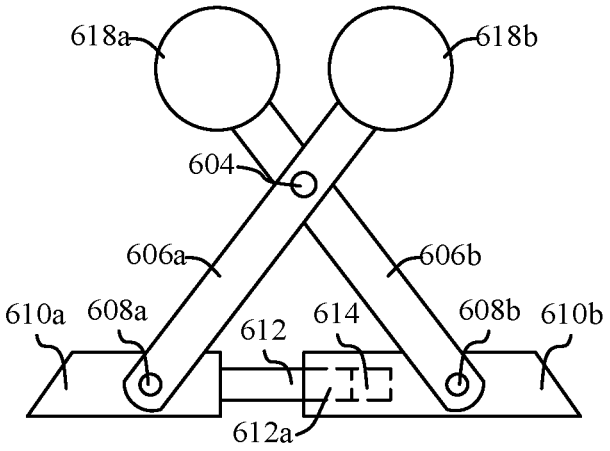
FIGS. 6A-6C are end views of openers for opening easy-open can ends shown in the above-mentioned figures.
Figure 6B:
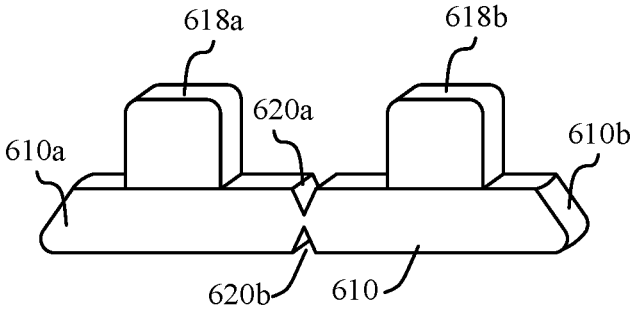
Figure 6C:
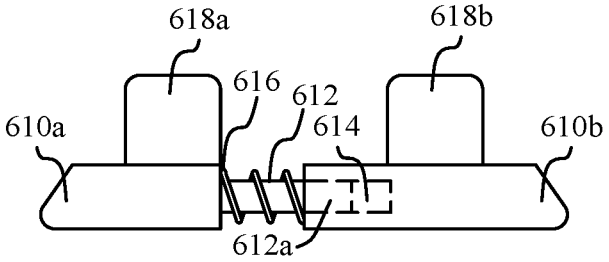

FIGS. 6A-6C are end views of openers for opening easy-open can ends shown in the above-mentioned figures, each of which comprises a score line, a tear panel defined by the score line and a hinge, and a protrusion or an impression on an end plate. Each of the openers comprises a rotating bar comprising two sections 610*a*, 610*b* for being pushed close to each other or away from each other to adjust a length of the rotating bar. The bottoms of the two sections 610*a*, 610*b* are used for being horizontally rotated over the tear panel to cause relative vertical movement between the tear panel and the remainder of the end plate, rupture of the score line, and swinging of the tear panel down about the hinge to an open position. Each of the openers has two fins 618*a*, 618*b* connecting directly or indirectly to the two sections 610*a*, 610*b* and providing points pushed by fingers of a user to control the two sections 610*a*, 610*b*.

FIG. 6A shows an opener further comprises two rods 606*a*, 606*b* comprising an axle 604 in a intersection of the two rods 606*a*, 606*b*. The first section 610*a* of the two sections 610*a*, 610*b* comprises a stick 612, and the second section 610*b* of the two sections 610*a*, 610*b* comprises a hole 614. The two fins 618*a*, 618*b* are on top of the two rods 606*a*, 606*b*, and the stick 612 is inserted into the hole 614 with a part 612*a* of the stick 612 located inside the hole 614. The two sections 610*a*, 610*b* are pushed close to each other or away from each other by controlling the two rods 606*a*, 606*b* to control a depth that the stick 612 inserts into the hole 614.

FIG. 6B shows another opener with the rotating bar further comprising two notches 620*a*, 620*b*. The notches 620*a*, 620*b* are between the two sections 610*a*, 610*b* and makes the rotating bar flexible to make it easier to push the two sections 610*a*, 610*b* close to each other or away from each other. Although this embodiment is illustrated with two notches 620*a*, 620*b*, either of them could be enough to make the rotating bar flexible.

FIG. 6C shows another opener further comprises a spring 616. The first section 610*a* of the two sections 610*a*, 610*b* comprises a stick 612; and the second section 610*b* of the two sections 610*a*, 610*b* comprises a hole 614. The stick 612 is inserted into the hole 614 with a part 612*a* of the stick 612 located inside the hole 614. And, The spring 616 covers the stick 612 and connects to the two sections 610*a*, 610*b* to produce elasticity between the two sections 610*a*, 610*b* while the two sections 610*a*, 610*b* are pushed close to each other or away from each other.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An easy-open can end for making an opening therethrough comprising an end plate;

a score line in the end plate defining a tear panel, while leaving between the tear panel and the remainder of the end plate a hinge, wherein the score line extends away from one end of the hinge, around a bight, and back to the other end of the hinge;

a protrusion formed on the tear panel wherein the protrusion is used for being pressed down by a rotating bar horizontally rotated over the protrusion to cause relative vertical movement between the tear panel and the remainder of the end plate, rupture of the score line, and swinging of the tear panel down about the hinge to an open position; and an extended wall encircling the end plate and defining a rotating space, wherein a circular opening of the extended wall is narrower than a circular bottom of the extended wall, the rotating space is used for containing the rotating bar, and the extended wall is used for confining movement of the rotating bar.

2. The easy-open can end of claim 1, further comprising the rotating bar.

3. The easy-open can end of claim 1, wherein the tear panel further comprises an extended part defined by the score line that further extends around another bight, and a ramp of the protrusion is formed on the extended part of the tear panel.

4. The easy-open can end of claim 1, wherein the hinge is formed near one side of the tear panel relative to a center line of the tear panel that passes through the center of the end plate and the center of the tear panel.

5. The easy-open can end of claim 1, wherein the hinge is formed in a center line of the tear panel that passes through the center of the end plate and the center of the tear panel.

6. The easy-open can end of claim 2, wherein the rotating bar comprises two inclined and rounded ends.

7. An easy-open can end for making an opening therethrough comprising an end plate;

a score line in the end plate defining a tear panel, while leaving between the tear panel and the remainder of the end plate a hinge, wherein the score line extends away from one end of the hinge, around a bight, and back to the other end of the hinge;

an impression formed on the end plate with a slope on the tear panel and a main part on the remainder of the end plate wherein the impression is used for containing a downward protrusion of a rotating bar that is horizontally rotated over the tear panel from the slope to press down the tear panel to cause a relative vertical movement between the tear panel and the remainder of the end plate, rupture of the score line, and swinging of the tear panel down about the hinge to an open position; and an extended wall encircling the end plate and defining a rotating space, wherein a circular opening of the extended wall is narrower than a circular bottom of the extended wall, the rotating space is used for containing the rotating bar, and the extended wall is used for confining movement of the rotating bar.

8. The easy-open can end of claim 7, further comprising the rotating bar with the downward protrusion.

9. The easy-open can end of claim 7, wherein the tear panel further comprises an extended part defined by the score line that further extends around another bight, and the slope of the impression is on the extended part of the tear panel.

10. The easy-open can end of claim 7, wherein the hinge is formed near one side of the tear panel relative to a center line of the tear panel that passes through the center of the end plate and the center of the tear panel.

11. The easy-open can end of claim 7, wherein the hinge is formed in a center line of the tear panel that passes through the center of the end plate and the center of the tear panel.

12. The easy-open can end of claim 7, further comprising a protrusion formed on the tear panel wherein the protrusion and the impression are formed on the same circle with the same center of the end plate and the protrusion has a ramp close to the impression.

13. The easy-open can end of claim 8, wherein the rotating bar comprises two inclined and rounded ends.

* * * * *